US005209636A

United States Patent [19]

Fannar

[11] Patent Number: 5,209,636

[45] Date of Patent: May 11, 1993

[54] METHOD AND APPARATUS FOR SETTING CLEARANCE BETWEEN FLUID DISPLACEMENT HOUSING AND ROTORS

[75] Inventor: Heimir Fannar, Davidson, N.C.

[73] Assignee: Ingersoll-Rand Company, Woodcliff Lake, N.J.

[21] Appl. No.: 802,596

[22] Filed: Dec. 5, 1991

[51] Int. Cl.[5] ..... F04D 29/60

[52] U.S. Cl. ..... 415/174.4; 415/174.3; 418/178

[58] Field of Search ..... 415/174.3, 174.4, 173.4, 415/140, 131; 418/178

[56] References Cited

U.S. PATENT DOCUMENTS

| | | | |
|---|---|---|---|
| 2,393,116 | 1/1946 | McCulloch et al. | 415/174.4 |
| 2,491,678 | 12/1949 | McCulloch et al. | 415/174.4 |
| 2,492,935 | 12/1949 | McCulloch et al. | 418/178 |
| 2,519,588 | 8/1950 | McCulloch | 418/178 |
| 2,587,222 | 2/1952 | Riester | 415/174.4 |
| 3,131,643 | 5/1964 | Marietta | 418/178 |
| 3,359,953 | 12/1967 | Groth | 418/178 |
| 3,512,788 | 5/1970 | Kilbane | 415/173.3 |
| 3,771,927 | 11/1973 | Schiller | 415/140 |
| 4,242,065 | 12/1980 | Ishizuka et al. . | |
| 4,369,020 | 1/1983 | Rahnke | 415/217.1 |
| 4,422,836 | 12/1983 | Meyman . | |
| 4,465,446 | 8/1984 | Nemit, Jr. et al. | 418/201.1 |
| 4,466,785 | 8/1984 | Biswas | 418/178 |
| 4,523,896 | 6/1985 | Lhenry et al. | 415/174.4 |

*Primary Examiner*—Edward K. Look
*Assistant Examiner*—Michael S. Lee
*Attorney, Agent, or Firm*—Glenn B. Foster; James R. Bell

[57] ABSTRACT

A spacer of a desired thickness sets the clearance between an end face of a fluid displacement device rotor and an end plate of a fluid displacement device housing. Initially the spacer is located on either the end face or the end plate. The end face is then positioned adjacent said end plate. Next, the rotor is axially displaced relative to the housing to a desired position wherein the spacer is in contact with both the end face and the end plate. Finally, the rotor is secured in said desired position.

10 Claims, 2 Drawing Sheets

METHOD AND APPARATUS FOR SETTING CLEARANCE BETWEEN FLUID DISPLACEMENT HOUSING AND ROTORS

BACKGROUND OF THE INVENTION

This invention relates generally to rotor assembly techniques and more particularly to a method and apparatus to set the clearance between a fluid displacement device housing and one or more fluid displacement device rotors in an axial direction relative to the rotors.

For fluid displacement devices to function properly, it is essential that the rotors be located within the housing as desired. Presently, to set the clearances between an end face of the fluid displacement device rotors and the fluid displacement device housing, the rotor has to initially be assembled onto the rear bearing housing secured with press fit bearings. The clearance between the end face of each rotor and an end plate of the housing is then measured to determine whether the clearance falls within permissible limits.

If the clearance does not fall within these permissible limits, then the press fit bearings have to be removed from the fluid displacement device rotors, and thicker or thinner shims added between the rotors and the housing to reposition the rotor axially relative to the rear bearing housing. When the rotors are reassembled onto the rear bearing housing, hopefully the positioning of the rotors with the new shims added will be proper.

This assembly, disassembly and reassembly process to ensure proper clearance is one of, if not the most, time consuming and expensive step in fluid displacement device fabrication.

The foregoing illustrates limitations known to exist in present fluid displacement device fabrication design. Thus, it is apparent that it would provide great advantages to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a spacer for a setting a clearance between an end face of fluid displacement device rotor and an end plate of a fluid displacement device housing, initially the spacer of a desired thickness is located on either the end face or the end plate. The end face is then positioned adjacent said end plate. Next, the rotor is axially displaced relative to the housing to a desired position wherein the spacer is in contact with both the end face and the end plate. Finally, the rotor is secured in said desired position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

In this disclosure, the term "fluid displacement device" is intended to cover any device which displaces any fluid against its natural flow tendencies. The primary fluid displacement devices are compressors and pumps.

Figure 1:
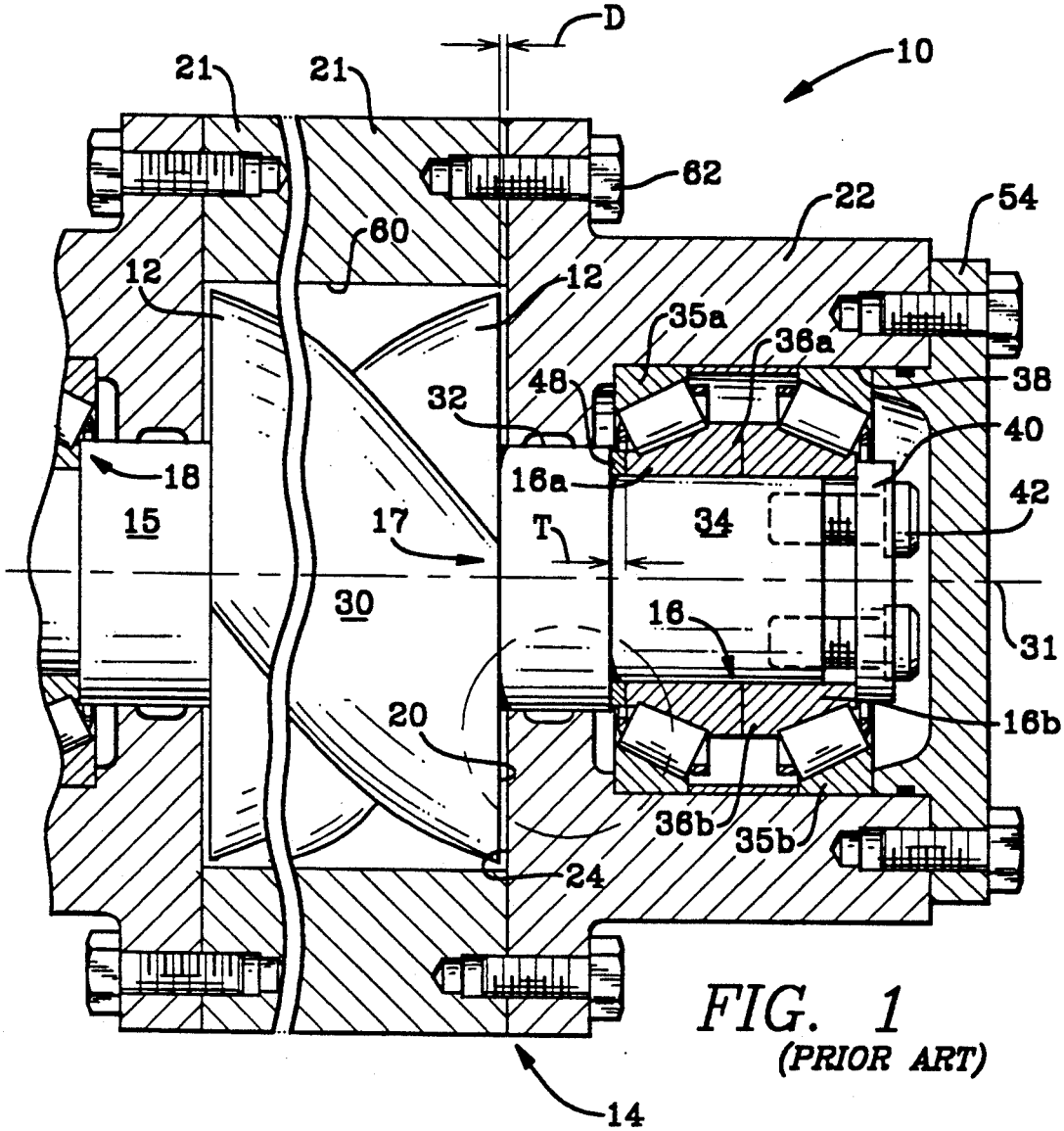
FIG. 1 (PRIOR ART)
FIG. 1 is a side cross sectional view illustrating a prior art embodiment of fluid displacement device housing with the rotor 12 in the assembled position.

In FIG. 1, A fluid displacement device 10 includes rotor 12 and housing 14. The rotor 12 may be either a single rotor, or more commonly matched with another rotor as is well known as a twin screw fluid displacement device. The rotor 12 is supported within a fluid displacement device housing 14 by bearings 18 and bearing assembly 16. A rear portion 15 of rotor 12 is free to slide axially within bearings 18, but is restricted against radial displacement when fluid displacement device 10 is in the assembled position.

A front portion 17 of rotor 12, which includes a middle diameter portion 32 and an end diameter portion 34 is supported by the bearing assembly 16. The middle diameter portion 32 and the end diameter portion 34 are both concentric about a rotor axis 31. The bearing assembly 16 includes an inner bearing 16*a* and an outer bearing 16*b*. Alternately, the bearing assembly 16 may be formed from a single bearing.

The fluid displacement device housing 14 includes a main housing portion 21 and a rear bearing housing 22. The bearings 16*a* and 16*b* include inner races 36*a* and 36*b* which are press fit onto the end diameter portion 34, and outer races 35*a* and 15*b* which are secured within the rear bearing housing 22 (when the fluid displacement device 10 is in the assembled position).

A main rotor body portion 30 of the rotor 12 has an end face 20 formed thereon. The end face 20 extends substantially perpendicular to a rotor axis 31. The rear bearing housing 22 includes an end plate 24 which, when the fluid displacement device 10 is fully assembled, is also substantially perpendicular to the rotor axis 31.

The primary focus of the present invention relates to maintaining the relative axial clearance D between the end face 20 and the end plate 24 within tight tolerances. If the tolerances are permitted to fall outside of the tight tolerances, then fluid displacement device operates inefficiently as well as possibly damaging the rotor or housing by contact therebetween.

A shaft clamp plate 40 is secured to the end diameter portion 34 by fasteners 42. The shaft clamp plate 40 engages with inner race 36*b* effectively coupling the rotor 12 to the inner race 36*b* of the outer bearing. The inner race of the inner bearing 16*a* is axially spaced from the middle diameter portion 32 by a bearing spacer 48. A thickness T of the bearing spacer 48 determines the spacing between the end face 20 and the end plate 24.

A cover 54 secures the outer races 35*a*, 35*b* against axial bearing displacement within the bore 38 (to the right in FIG. 1). The cover is also used to restrict passage of grease and dirt between within the rear bearing housing section 22 and the atmosphere, and also limits the damage to the rotor 12 and bearing assembly 16 from contact with other structures. The cover 54 is secured to the rear bearing housing 22 by fasteners. The outer races 35a, 35b loosely fit within a bore 38 formed in the rear bearing housing.

To assemble the FIG. 1 prior art fluid displacement device 12, initially the middle diameter portion 32 is fitted within the rear bearing housing section 22 when the rear bearing housing section is removed from the main housing portion 21. The bearing spacer 48 (which may be formed as a plurality of shims) is then slid into position radially surrounding the end diameter portion 34 adjacent the middle diameter portion 32. The inner races 36a, 36b of the bearings 16a, 16b are then expanded by heat permitting the bearings 16a, 16b to securely encase the end diameter portion, and then the bearings 16a, 16b are positioned over the end diameter portion 34. As the inner races 36a, 16b cools, a press fit results between the end diameter portion. The shaft clamp plate is then more securely affixed to the end diameter portion 34 by fasteners.

The distance between the end face 20 and the end plate 24 is then compared against tight tolerances. If the tolerances fall outside of the tolerances, then the press fit between the end diameter portion 34 and both of the inner races 36a and 36b must be broken. The thickness of the bearing spacer 48 must then be effectively altered by the addition or removal of shims adjacent the bearing spacer 48. Not only does the process of inner race removal result in possible damage to the rotor 12, but it is difficult and time consuming. Presently, the setting of clearances between the end plate 24 and the end face 20 is one of the major time consuming activities in fluid displacement device fabrication and assembly.

When the tolerances between the end face 20 and the end plate 24 finally fall within the allowable limits, the rotor 12 is slid within a recess 60 formed in the main housing portion 21 until the rear portion 15 can be located within bearing 18. At this time, the rear bearing housing section 22 is secured adjacent the main housing portion 21 using fasteners 62 as illustrated in FIG. 1.

Figure 2:
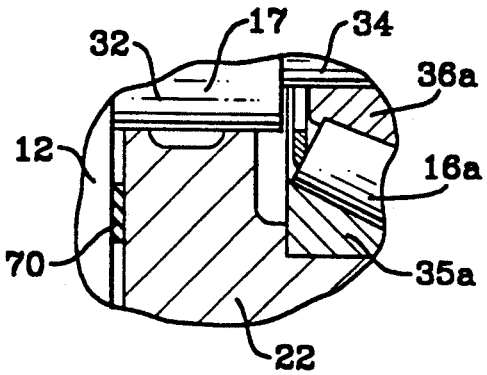
FIG. 2 is an enlarged view similar to the encircled portion of FIG. 1 illustrating on embodiment of fluid displacement device housing with the associated rotors of the present invention, having a wear sleeve positioned therebetween.
Figure 3:
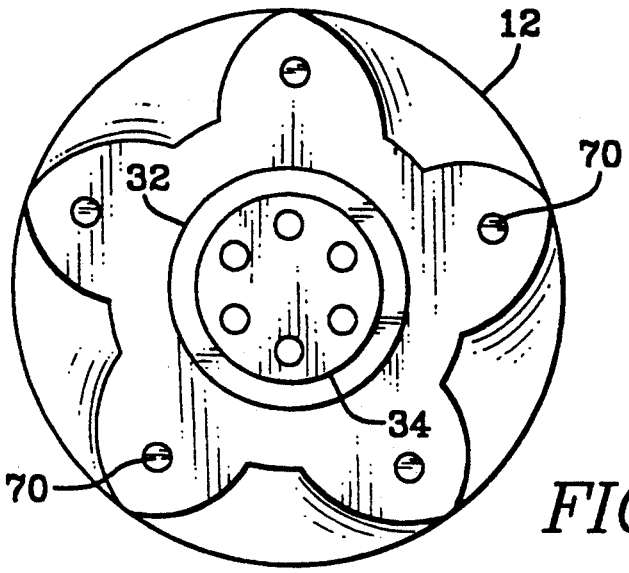
FIG. 3 is an end view of the rotor 2 illustrated in FIG. 2.
Figure 4:
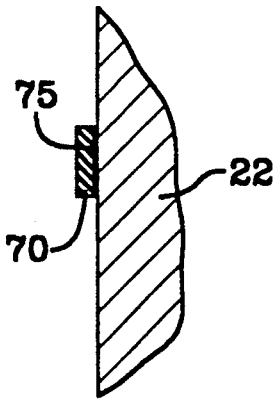
FIG. 4 is a view of an end plate of an alternate embodiment of the present invention, wherein the wear pads are affixed to the end plate.

The present invention, embodiments of which are illustrated in FIGS. 2, 3 and 4, differs from the FIG. 1 prior art by the exclusion of the bearing spacer 48 and the addition of at least one wear pad 70 which controls the clearance between the end face 20 and the end plate 24. The wear pad 70 may be either initially formed as a unitary portion of the rotor or housing as illustrated in FIGS. 2 and 3, or alternately may be adhered to the rotor or housing by some adhesive 75 well known in the art as illustrated in FIG. 4. The purpose of the wear pads 70 is to directly, accurately, inexpensively, simply and repeatably produce a desired clearance between the end face 20 and the end plate 24.

The wear pads are constructed from such a material as when the rotor begins operation for the first time in the assembled condition, any portion of the wear pad which interferes with the end plate 24 if the wear pad is attached to the end face 20 (or contacts the end face 20 if the wear pad is attached to the end plate 24) will quickly be worn away. The volume of the wear pad is so small that the abraded portion of the wear pad will not adversely affect the operation of the fluid displacement device 10.

Suitable material to construct the wear pads 70 from include, but are not limited to, non-metallic composites (and may actually be formed as a unitary portion of the rotor or housing), a rubber or a plastic material. The wear pad may effectively be formed from any material possessing adequate properties to accurately reproduce the clearance and quickly abrade when the fluid displacement device begins operation and the rotor displaces relative to the housing.

The assembly of the FIGS. 2, 3 and 4 embodiments of fluid displacement device utilizing wear pads 70 of the present invention involves initially ensuring the wear pad 70 of the proper thickness is properly affixed to the end face 20 or the end plate 24. Outer race 35a is inserted into rear bearing housing 22. The end diameter portion 32 is slid into the rear bearing housing 22 and inner races 36a and 36b are secured onto end diameter portion 34. The outer race 35b, the clamp plate 40 and end cover 54 are then secured into position.

The wear sleeve 70 of the present invention, being positioned between the end plate 24 and the end face 20, directly controls the clearance D. The prior art bearing spacers 40 are positioned between the middle diameter portion 32 and the rear bearing housing 22 to remotely control the clearance D. The remote prior art technique permits more cumulative errors to be made relative to the tolerances of the clearance D than the directly positioned present invention.

The wear sleeve of the present invention represents a positive and minimal cost solution to an extremely expensive, laborious and time consuming problem in fluid displacement device fabrication.

While this invention has been illustrated an described in accordance with a preferred embodiment, it is recognized that other variations and changes may be made therein without departing from the invention as set forth in the claims. While this disclosure describes the rear bearing housing as separate from the main housing, these two elements may be manufactured as a single element.

I claim:

1. A method for setting a clearance of an end face of a fluid displacement device rotor relative to an end plate of a fluid displacement device housing, including the steps of:

locating a spacer of a desired thickness on said end face, the spacer being discrete and incapable of any sealing action;

positioning the end face adjacent said end plate;

axially displacing the rotor relative to the housing to a desired position wherein the spacer is in contact with the end plate; and securing the rotor in said desired position.

2. The method for setting a clearance as described in claim 1, wherein said spacer is an integral portion of said rotor.

3. The method for setting a clearance as described in claim 1, wherein said spacer is a distinct element from said rotor.

4. The method for setting a clearance as described in claim 3, wherein during said locating step, the spacer is affixed to the rotor by an adhesive.

5. The method for setting a clearance as described in claim 1, further including the step of:

rotating said rotors after the rotor is secured.

6. The method for setting a clearance as described in claim 5, wherein said rotation abrades said spacer thereby providing a clearance between the end face and the spacer.

7. A fluid displacement device comprising:

a housing including an end plate;

a rotor disposed within said housing, said rotor having an end face;

a wearable spacer means, the spacer being discrete and incapable of any sealing actions, having a predetermined thickness, affixed to said end plate for setting the clearance between the end plate and the end face; and securing means for securing the rotor relative to said housing wherein said clearance is maintained.

8. The fluid displacement device as described in claim 7, wherein the securing means comprise bearings disposed between the housing and the rotor.

9. The fluid displacement device as described in claim 7, wherein the rotor rotatably engages with a second rotor disposed within the housing.

10. The fluid displacement device as described in claim 9, wherein the two rotors are of a twin screw variety.

* * * * *